US005551275A

United States Patent [19]

Hofele et al.

[11] Patent Number: 5,551,275

[45] Date of Patent: Sep. 3, 1996

[54] MULTIPLE STAND PRESS

[75] Inventors: Hans Hofele; Wolfgang Michael, both of Goeppingen; Kurt Strommer, Kuchen; Karl Thudium, Waeschebeuren, all of Germany

[73] Assignee: Schuler Pressen GmbH, Germany

[21] Appl. No.: 258,069

[22] Filed: Jun. 10, 1994

[30] Foreign Application Priority Data

Jun. 11, 1993 [DE] Germany ..... 43 19 338.2

[51] Int. Cl.[6] ..... B21J 9/18

[52] U.S. Cl. ..... 72/450; 72/455

[58] Field of Search ..... 72/405, 421, 450, 72/455, 456, 405.11, 405.1

[56] References Cited

U.S. PATENT DOCUMENTS

| | | | |
|---|---|---|---|
| 2,243,952 | 6/1941 | Glasner | 72/456 |
| 3,082,725 | 3/1963 | Cannon | 72/450 |
| 4,089,205 | 5/1978 | Mizumoto et al. | 72/450 |
| 4,102,174 | 7/1978 | Blase | 72/421 |
| 4,895,013 | 1/1990 | Sofy | 72/405 |
| 5,001,921 | 3/1991 | Schneider | 72/405 |
| 5,375,513 | 12/1994 | Michael | 72/405 |

FOREIGN PATENT DOCUMENTS

| | | | |
|---|---|---|---|
| 781698 | 4/1968 | Canada | 72/450 |
| 0581008A2 | 2/1994 | European Pat. Off. . | |
| 2075213 | 10/1971 | France . | |
| 2238239 | 9/1973 | Germany | 72/455 |
| 3118955 | 3/1986 | Germany . | |
| 4124083 | 1/1993 | Germany . | |
| 587883 | 5/1947 | United Kingdom | 72/450 |
| 1292750 | 10/1972 | United Kingdom | 72/455 |
| 1440420 | 6/1976 | United Kingdom | 72/450 |

*Primary Examiner*—Daniel C. Crane
*Attorney, Agent, or Firm*—Evenson, McKeown, Edwards & Lenahan, P.L.L.C.

[57] ABSTRACT

A multiple stand press or similar press facility for the forming of sheet metal parts has a bedplate, several press stands, and a press slide 7 which can be moved up and down by the press drive via drive gear boxes and connection rods. Tools in progressive stations follow a drawing station. In order to be able to reduce the size of the press facility, the press slide extends along at least two stand areas, and the introduction of force takes place via the connecting rods into the press slide in the stand areas.

11 Claims, 5 Drawing Sheets

FIG. 9
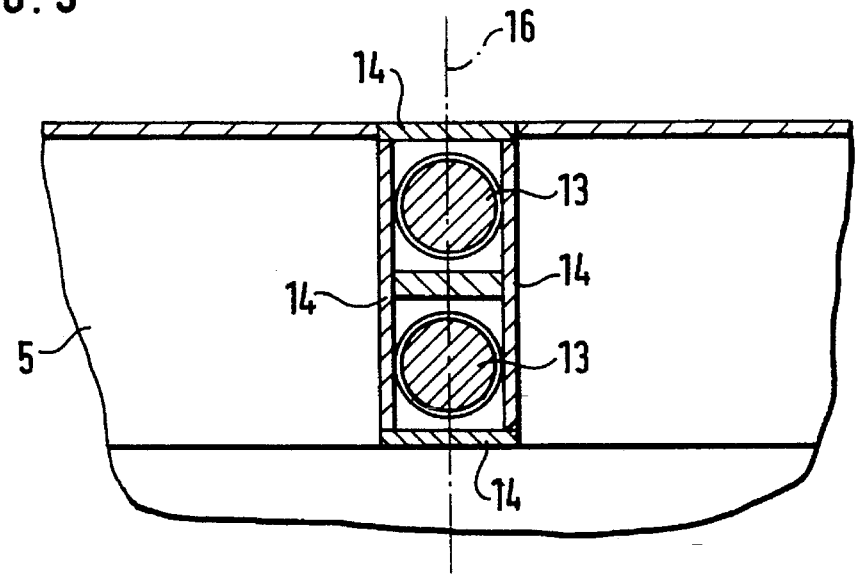
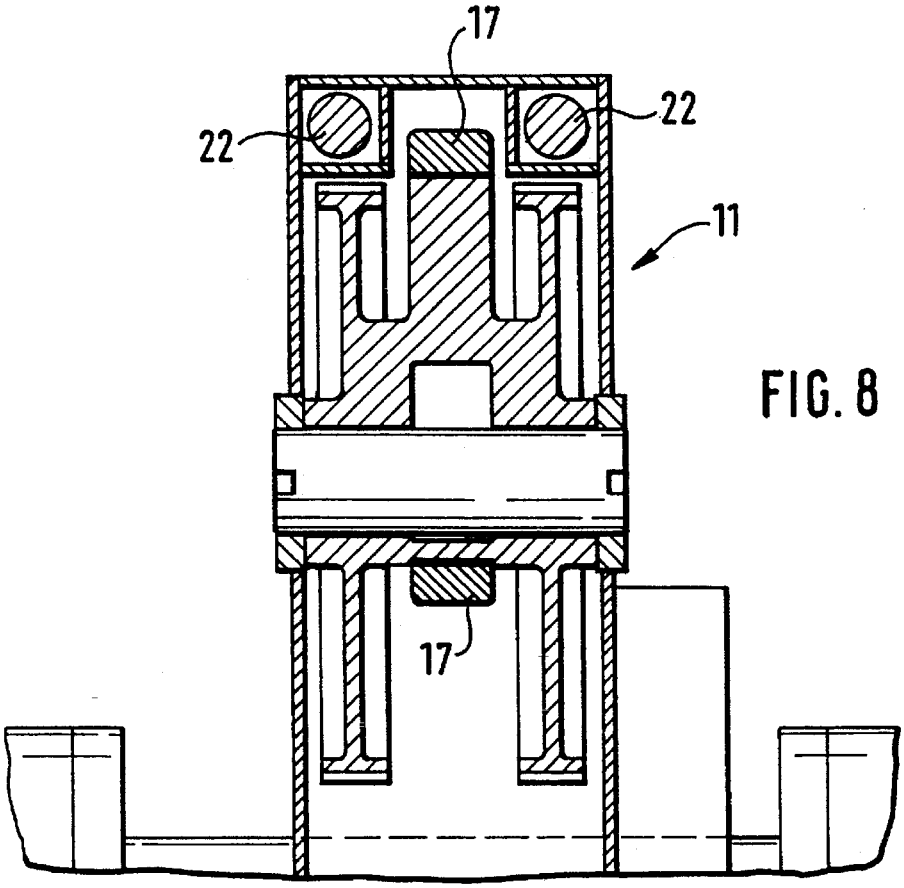
FIG. 8

MULTIPLE STAND PRESS

This invention relates to a multiple stand press, a transfer press or multistation press, a hybrid press system or similar forming or press facility comprising mutually opposite press stands. A drawing station may be provided which has a press slide drive and a drawing apparatus. Press facilities of this type are used for forming a sheet bar, a round plate or similar sheet metal parts, in which case the first station may provide the drawing for producing the initial shape for the further forming. The invention also relates to areas which are generally called progressive stations and in which the preformed sheet metal part obtains its final shape. The invention also relates to those presses in which the slide drive is arranged above the press slide and thus introduces the force in the center or in the edge areas of the press slide. The invention therefore relates to press facilities with a mechanical or hydraulic drive.

Press facilities of this type are known, for example, from U.S. Pat. No. 4,102,174, and German Patent Documents DE-C2 31 18 955, DE-A1-39 05 068 and DE-A1-41 24 083. In addition, German Patent Documents DE-A1-39 05 068 and DE-A1-41 24 083 show the use of divided press slides in the progressive stations as well as intermediate depositing devices behind each machining station.

It is desirable to reduce the costs for the press constructions which have become expensive as the result of such measures. The total number of structural members, the consumption of material and therefore the investment costs for the user must clearly be reduced. For this purpose, the present invention uses new approaches which are inventive individually and combined.

It is an object of the invention to reduce the length of the overall production space while eliminating intermediate depositing devices and to place the drives of the now one press slide in the area of previously existing vacant stations (intermediate stand areas).

This and other objects are achieved according to the present invention which provides that the press slide as well as the bedplate each represent a one-piece structure for the operating condition, and that the transport and the mounting may comprise several stand parts and components which can be connected with one another. A plurality of force introduction points are eliminated in comparison to the former use of, for example, five press slides in the case of five progressive stations with up to twenty connecting rods.

Certain features of certain embodiments of the invention significantly minimize the force deflection. The drive gear boxes are reduced to the width of the required waste disposal shafts. This object is also achieved according to certain embodiments whereby the width of the stand area could be reduced significantly.

Other objects, advantages and novel features of the present invention will become apparent from the following detailed description of the invention when considered in conjunction with the accompanying drawings.

BRIEF DESCRIPTION OF THE DRAWINGS

FIG. 8 is a partial sectional view of the drive gear box corresponding to section VIII—VIII of FIG. 6.

FIG. 9 is a partial sectional view according to section IX—IX in FIG. 7.

DETAILED DESCRIPTION OF THE DRAWINGS

Figure 1:
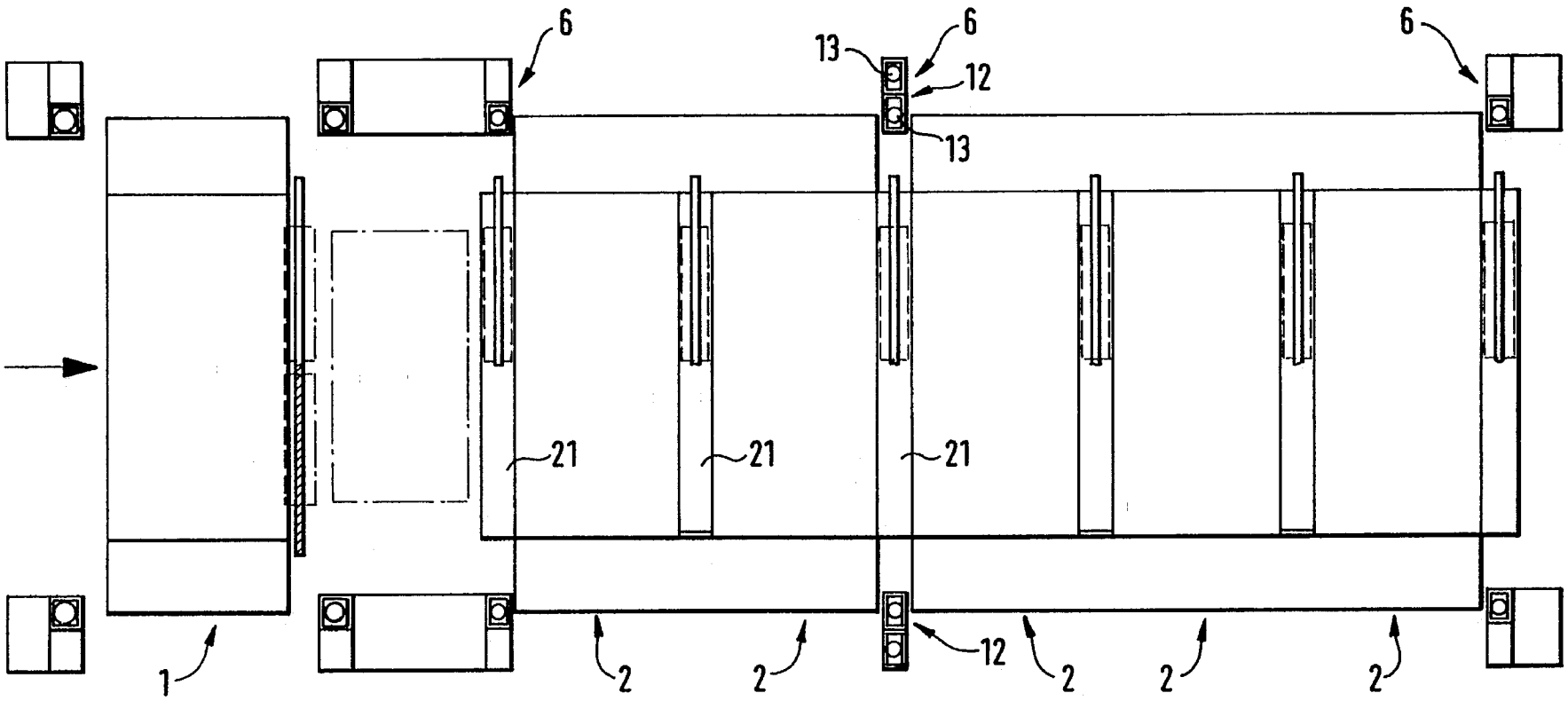
FIG. 1 is a view of the overall production space of a press facility according to an embodiment of the present invention in the manner of a space assignment plan.
Figure 3:
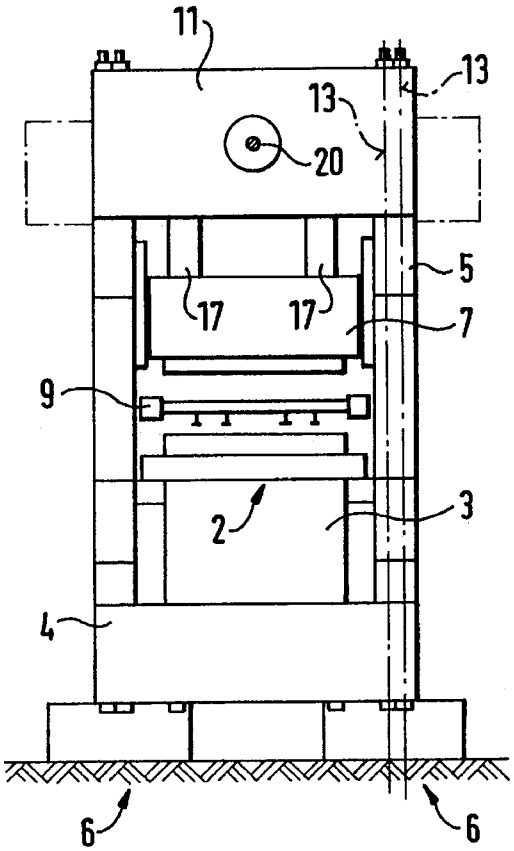
FIG. 3 is a sectional view III—III of the press facility illustrated in FIG. 2.
Figure 2:
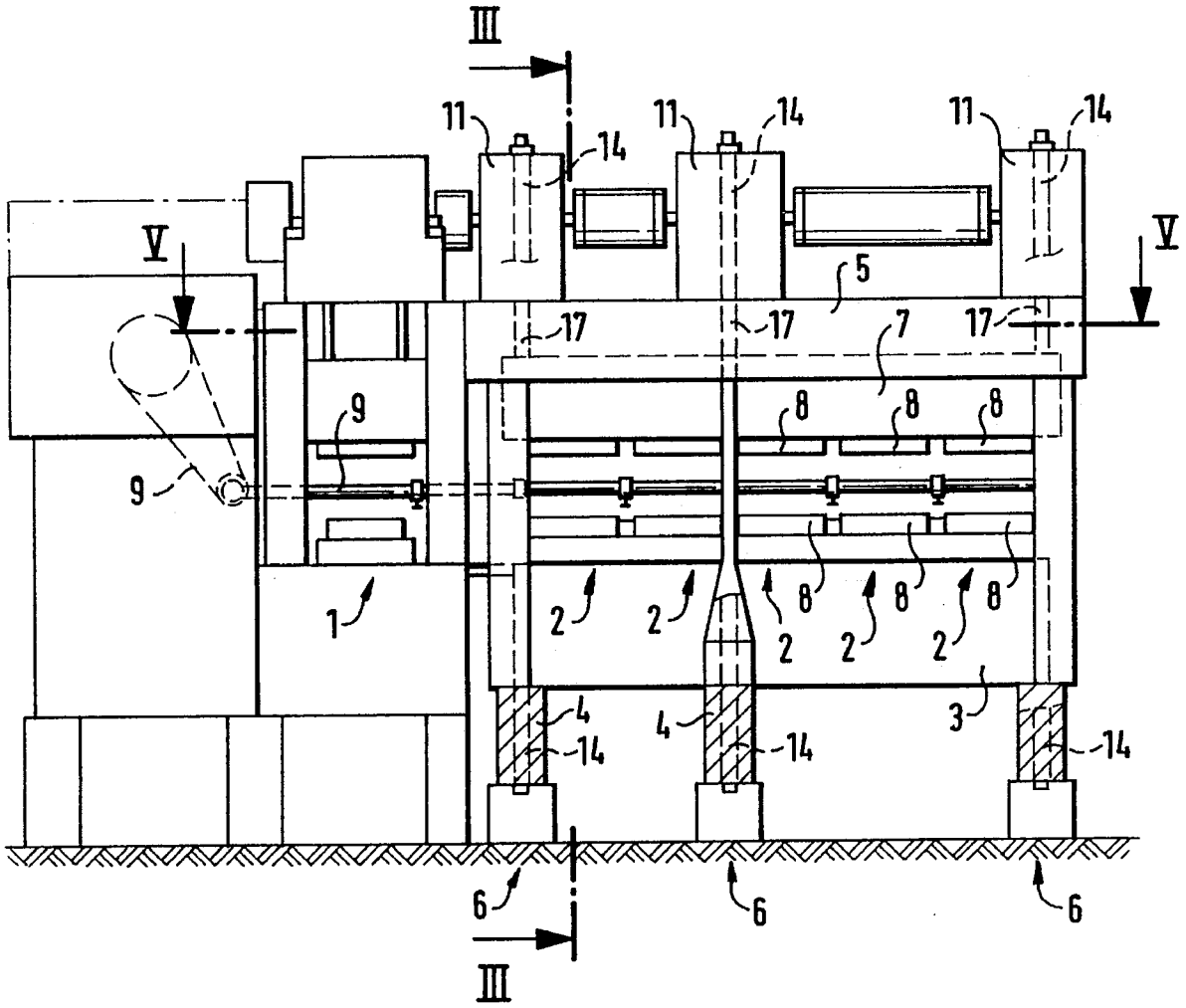
FIG. 2 is a frontal view of a press facility according to the present invention.

In the figures, identical parts have the same reference numbers. Only the structural components of the press facility which are specific to the presses and important for describing the invention are shown and are significantly reduced in size. FIG. 1 illustrates the location of a press facility comprising a drawing station 1 which may also be placed in front as an individual press. FIG. 2 characterizes progressive stations of a three-stand press which in this embodiment has two and three, and therefore a total of five, machining stations. Reference number 6 indicates the areas of press stands. It is shown that a stand 6 is constructed with a double tie rod 13. Instead of a tie rod of a larger diameter for each stand area 6, in this case, for example, for the center stand area of three stand areas 6 along which a press slide 7 (FIG. 2) extends, two tie rods 13 respectively are arranged along an imaginary common line drawn between the centers of the tie rods which have a significantly reduced cross-section. Mutually opposite stands or stand areas 6 form a pair of stands 12. Reference number 21 indicates waste disposal shafts which extend along the width of the press space and may be arranged in front of and behind each progressive station 2. The size of the waste disposal shafts, particularly their width measured in the press passage direction, depends on the occurring waste. The present invention aims at the elimination of the intermediate depositing devices in the so-called vacant station areas and at a reduction of the width of the stand areas 6.

FIG. 2 illustrates a multiple stand press as a progressive station press, in which case the drawing press with the drawing station 1 which is connected in front may also be eliminated. This multiple stand press with, for example, three press stands, or stand areas 6, on the side of the foundation, is set up via transverse bars 4 which extend along the width of the multiple stand press. Reference number 3 indicates the bedplates of the presses, which are fixedly placed on the traverses 4, and which in certain embodiments are constructed in one piece and carry the sliding tables with the tools 8. The top parts of the tool are fastened during the operation to the press slide 7, which is in one piece.

Figure 4:
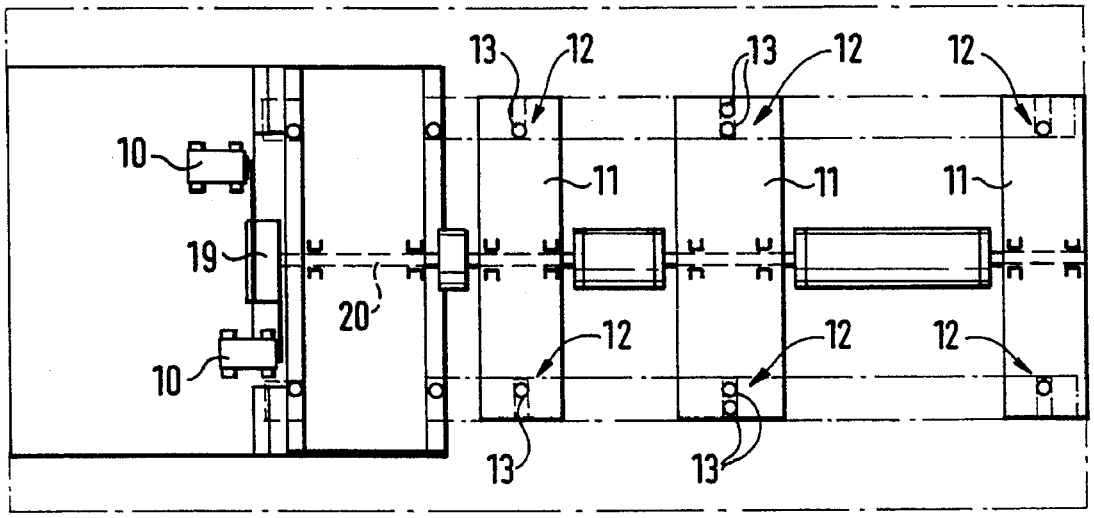
FIG. 4 is a top view of the press facility illustrated in FIG. 2.
Figure 5:
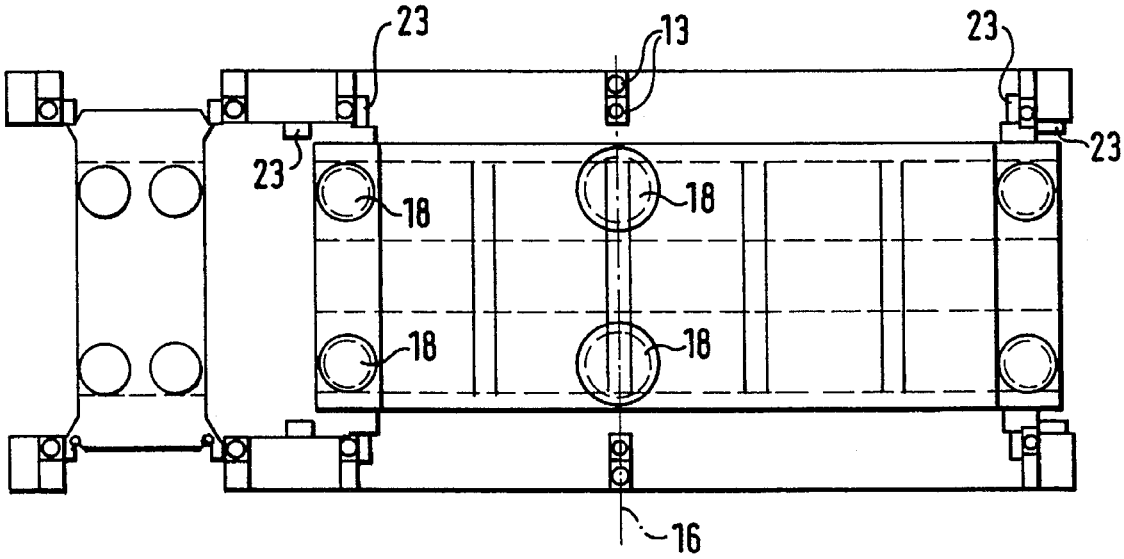
FIG. 5 is a top view of the press facility corresponding to section V—V shown in FIG. 1.

In front of and behind the press slide 7, the press stands 6 are in each case connected by longitudinal supports 5. Drive gear boxes 11 are placed in the area above the press stands 6. The drive gear boxes 11 are used for receiving movement deflecting devices. They are also used in certain embodiments, for example, to receive hydraulic driving devices for the lifting and lowering movement of the press slide 7. The drive of the devices in the drive gear boxes 11 takes place via motors 11, a driven plate 19 and a driven shaft 20 outside the drive gear boxes 11, as indicated in FIG. 4. In this case, the press slide 7 is driven in three planes corresponding to the number of stand areas 6 via connecting rods 17 guided downward out of the drive gear boxes 11. A transfer device 9 for the transport of sheet metal parts in the stations is guided through the press facility extending in the passage direction of the press.

FIGS. 3, 4, 5, 7, and 9 show the double arrangement of tie rods 13 in the center stand area 6. The tie rods 13, as a whole, are all surrounded by tie rod sleeves 14 for the purpose of support, dimensional accuracy and absorption of force. Corresponding to FIG. 5, the press slide 7 is disposed in longitudinal or linear bearings 23 in a liftable and lowerable manner. The introduction of force—the point of application of the connecting rods 17 to the press slide 7—is characterized by circles 18.

Figure 6:
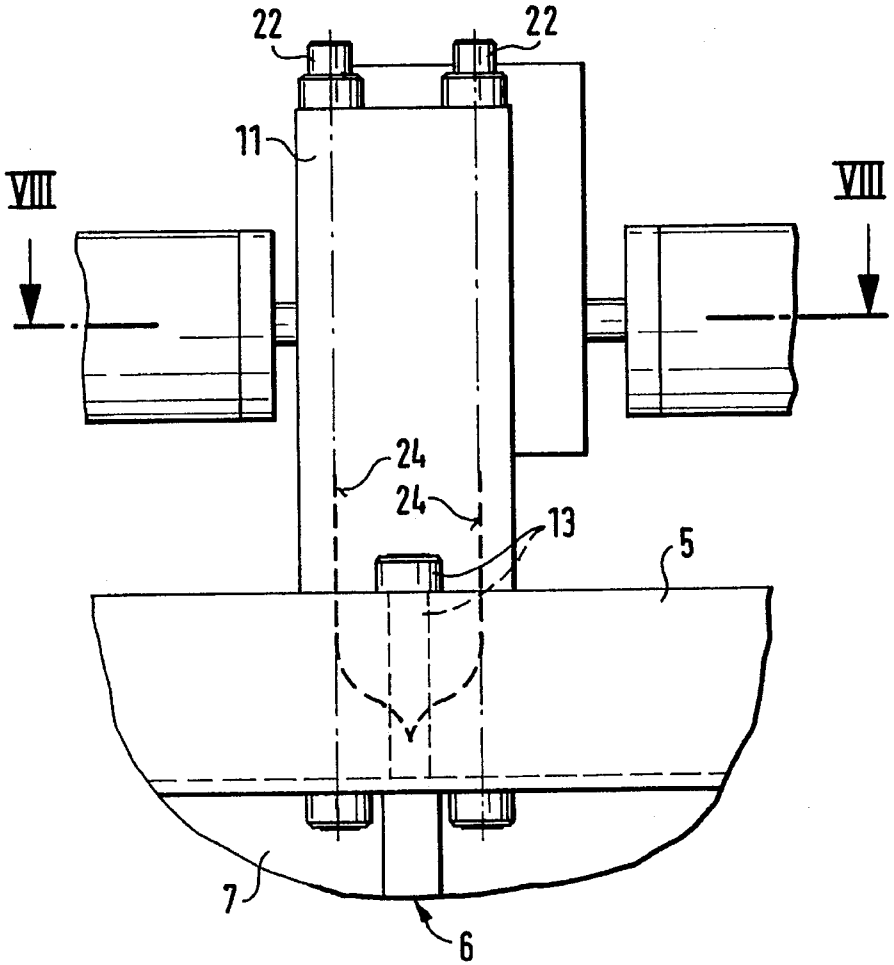
FIG. 6 is a view of a drive gear box which extends along a pair of stands.

FIG. 6 shows one of several drive gear boxes 11—in this case, the drive gear box 11 arranged in the center area of the press slide 7. The drive gear box 11 is placed above the press stands 6 on the longitudinal supports 5 extending in front of and behind the press slide 7 and is fastened via four tie rods 22 with tie rod sleeves.

Figure 7:
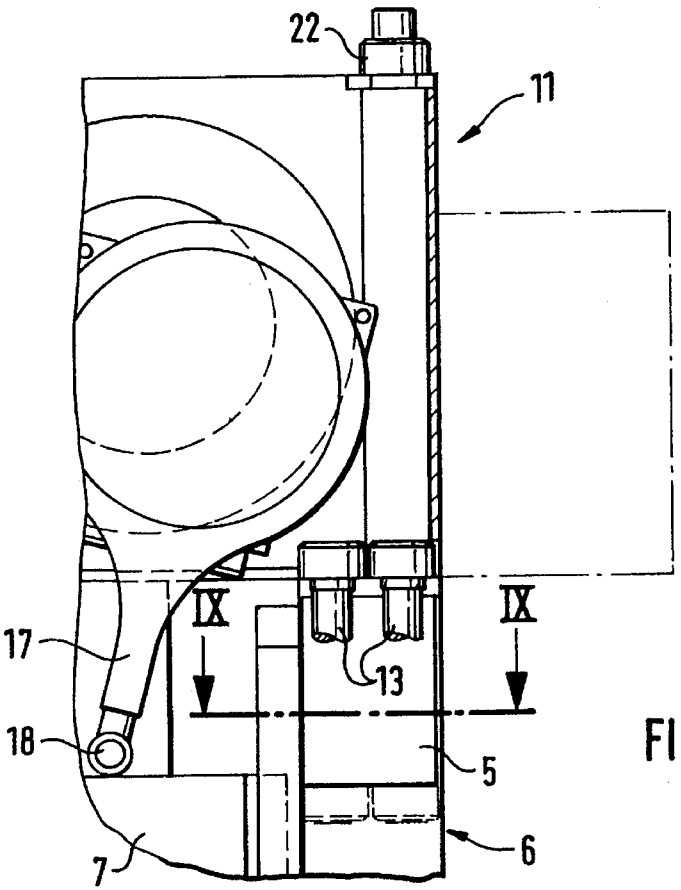
FIG. 7 is a partial view into the drive gear box illustrated in FIG. 6.

FIGS. 7 and 8 show driving devices which are moved by the main shaft 20 (FIG. 4), among other devices, a connecting rod 17 with the introduction of force 18 into the press slide 7. The centers of the tie rods 13 of a pair of stands 12 and the center of the introduction of force 18—connecting rod 17—into the press slide 7 are situated on a common line 16. For the central introduction of force 18, both of the tie rods 13 required here are situated on this common line 16.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A multiple stand press for the forming of sheet metal parts, comprising:

at least one bedplate;

pairs of press stands, each press stand forming a stand construction for the press, the press stands positioned at spaced locations on the bedplate;

at least one press slide driven by a press drive, wherein the press slide extends between at least two pairs of the press stands;

tools operatively arranged on the press slide and on the bedplate and cooperating so as to form the sheet metal parts;

waste disposal shafts operatively associated with the tools; and connecting rods linked to the press slide and via which an introduction of force in the areas of the press stands takes place, wherein for each pair of the press stands, two of said connecting rods are operatively associated with the press slide, wherein the press slide extends along three pairs of the press stands, and wherein the introduction of force takes place via the connecting rods in the area of each of the three pairs of the press stands.

2. A multiple stand press according to claim 1, further comprising at least one drive gear box in which driving, moving and deflecting devices for a slide drive are operatively accommodated, said at least one drive gear box being separately located on opposite press stands and are fastened to the at least one pair of press stands.

3. A multiple stand press according to claim 1, wherein at least one of the press stands in an area of a central introduction of force into the press slide comprises two tie rods and two tie rod sleeves arranged such that centers of the tie rods are arranged on a common line.

4. A multiple stand press for the forming of sheet metal parts, comprising:

at least one bedplate;

pairs of press stands, each press stand forming a stand construction for the press, the press stands positioned at spaced locations on the bedplate;

at least one press slide driven by a press drive, wherein the press slide extends between at least two pairs of the press stands;

tools operatively arranged on the press slide and on the at least one bedplate and cooperating so as to form the sheet metal parts;

waste disposal shafts operatively associated with the tools; and connecting rods linked to the press slide and via which an introduction of force takes place in the areas of the at least one pair of press stands, wherein at least one of the press stands in an area of a central introduction of force into the press slide each comprises two tie rods and two tie rod sleeves arranged such that centers of the tie rods are arranged on a common line.

5. A multiple stand press, for the forming of sheet metal parts, comprising:

at least one bedplate;

pairs of press stands, each press stand forming a stand construction for the press, the press stands positioned at spaced locations on the bedplate;

at least one press slide driven by a press drive, wherein the press slide extends between at least two pairs of the press stands;

tools operatively arranged on the press slide and on the at least one bedplate and cooperating so as to form the sheet metal parts;

waste disposal shafts operatively associated with the tools; and connecting rods linked to the press slide and via which an introduction of force takes place in the areas of the press stands wherein the press slide continuously extends along three pairs of the press stands, and wherein the introduction of force takes place via the connecting rods in the area of each of the pairs of the press stands.

6. A multiple stand press, comprising:

at least one bedplate;

pairs of press stands, each press stand forming a stand construction for the press, the press stands positioned at spaced locations on the bedplate;

a press slide;

a tool operatively associated with the press slide in relation to a tool on a side of the at least one bedplate;

waste disposal shaft operatively associated with the tools;

the press slide extending along three pairs of the press stands each defining press stand areas; and two connecting rods associated with each press stand area and the press stands, and hingedly linked with the respective press stand area.

7. A multiple stand press according to claim 6, further comprising:

drive gear boxes in which driving, moving and deflecting devices for a slide drive are operatively accommodated, said drive gear boxes being separately located on opposite ones of the press stands and are fastened thereto.

8. A multiple stand press according to claim 6, wherein at least the press stand in an area of a central introduction of force into the press slide comprises two tie rods and two tie rod sleeves arranged such that centers of the tie rods are arranged on a common line.

9. A multiple stand press according to claim 6, wherein the introduction of force takes place via the connecting rods in the area of each of the three pairs of the press stands.

10. A multiple stand press according to claim 9, further comprising drive gear boxes in which driving, moving and deflecting devices for a slide drive are operatively accommodated, said drive gear boxes being separately located on opposite press stands and are fastened thereto.

11. A multiple stand press according to claim 9, wherein at least one of the press stands in an area of a central introduction of force into the press slide comprises two tie rods and two tie rod sleeves arranged such that centers of the tie rods are arranged on a common line.

* * * * *